US007875200B2

(12) United States Patent
Velez et al.

(10) Patent No.: US 7,875,200 B2
(45) Date of Patent: Jan. 25, 2011

(54) METHOD FOR A REPAIR PROCESS

(75) Inventors: Ramon M. Velez, Windsor, CT (US); Peter J. Draghi, Simsbury, CT (US); Clyde R. Everett, Burlington, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 12/123,504

(22) Filed: May 20, 2008

(65) Prior Publication Data

US 2009/0291205 A1 Nov. 26, 2009

(51) Int. Cl.
*B44C 1/22* (2006.01)

(52) U.S. Cl. ..... 216/83; 216/96; 216/108; 427/140; 427/142

(58) Field of Classification Search ..... 216/83, 216/96, 108; 427/140, 142
See application file for complete search history.

(56) References Cited

U.S. PATENT DOCUMENTS 2,302,513 A 11/1942 Abraham, Jr.
4,055,705 A 10/1977 Stecura et al.
4,095,003 A 6/1978 Weatherly et al.
4,894,130 A * 1/1990 Sova ..... 205/709
4,910,092 A * 3/1990 Olson et al. ..... 428/557
4,973,445 A * 11/1990 Singheiser ..... 420/443
5,167,721 A 12/1992 McComas
5,686,000 A 11/1997 Nilsson
5,735,448 A * 4/1998 Draghi et al. ..... 228/119
5,813,118 A 9/1998 Roedl et al.
5,851,409 A 12/1998 Schaeffer
5,938,855 A 8/1999 Bowden
5,944,909 A * 8/1999 Reeves et al. ..... 134/3
5,972,424 A 10/1999 Draghi
5,976,265 A * 11/1999 Sangeeta et al. ..... 134/3
6,042,879 A * 3/2000 Draghi et al. ..... 427/142
6,158,957 A 12/2000 Marcin
6,494,960 B1 * 12/2002 Macdonald et al. ..... 134/3

(Continued)

FOREIGN PATENT DOCUMENTS

EP 1057899 A2 6/2000

(Continued)

OTHER PUBLICATIONS

Extended European Search Report for EP09250999 mailed on Sep. 21, 2009.

*Primary Examiner*—Shamim Ahmed
(74) *Attorney, Agent, or Firm*—Carlson, Gaskey & Olds PC

(57) ABSTRACT

A method for a repair process includes the steps of subjecting a substrate coated with at least one protective metallic coating to a nitric acid solution and then subjecting the substrate with the at least one protective metallic coating to a hydrochloric acid solution to remove the at least one protective metallic coating from the substrate. The substrate includes about 5 wt %-15 wt % chromium, about 2 wt %-8 wt % cobalt, about 2 wt %-6 wt % tungsten, about 0.5 wt %-2.5 wt % titanium, about 8 wt %-16 wt % tantalum, about 2 wt %-8 wt % aluminum, hafnium in an amount no greater than 1 wt %, and a remainder of nickel.

20 Claims, 1 Drawing Sheet

U.S. PATENT DOCUMENTS

| | | | | |
|---|---|---|---|---|
| 6,599,416 | B2 | 7/2003 | Kool | |
| 6,673,467 | B2 * | 1/2004 | Scarlin et al. | 428/615 |
| 6,743,350 | B2 * | 6/2004 | Lee et al. | 205/686 |
| 6,916,429 | B2 | 7/2005 | Kool | |
| 7,008,553 | B2 | 3/2006 | Wustman | |
| 7,270,764 | B2 | 9/2007 | Wustman | |
| 2004/0005477 | A1 * | 1/2004 | Stamm | 428/678 |
| 2005/0115926 | A1 * | 6/2005 | Kool et al. | 216/109 |
| 2008/0163786 | A1 * | 7/2008 | Feng et al. | 106/1.21 |

FOREIGN PATENT DOCUMENTS

| | | | |
|---|---|---|---|
| EP | 1055741 | A2 | 11/2000 |
| EP | 1437425 | A1 | 7/2004 |
| EP | 1752562 | A1 | 2/2007 |
| EP | 1788125 | A2 | 5/2007 |

* cited by examiner

METHOD FOR A REPAIR PROCESS

BACKGROUND OF THE INVENTION

This disclosure relates to a repair process and, more particularly, to a method for removing a metallic coating from a nickel substrate in a repair process.

Airfoils and other articles typically operate in relatively harsh environments. For instance, an airfoil may operate under high temperatures, corrosive conditions, and a variety of different stress states. Typically the article is designed with an alloy material to withstand the harsh environment. However, the article may also include a coating for additional protection. For example, the coating may be a diffused aluminide or ceramic coating. After a period of use, the article may be repaired or restored before another cycle of use.

SUMMARY OF THE INVENTION

An example method for a repair process includes subjecting a substrate coated with a protective metallic coating to a nitric acid solution and then subjecting the substrate with the protective metallic coating to a hydrochloric acid solution to remove the protective metallic coating from the substrate. The substrate includes about 5 wt %-15 wt % of chromium, about 2 wt %-8 wt % of cobalt, about 2 wt %-6 wt % of tungsten, about 0.5 wt %-2.5 wt % of titanium, about 8 wt %-16 wt % of tantalum, about 2 wt %-8 wt % of aluminum, hafnium in an amount no greater than 1 wt %, and a balance of nickel.

In another aspect, an example method for a repair process includes subjecting a nickel-based substrate coated with a protective metallic coating to a nitric acid solution having a molarity of 0.07M-0.80M at a first temperature of about 65° F.-160° F. and then subjecting the nickel-based substrate coated with the at least one protective metallic coating to a hydrochloric acid solution having a molarity of 0.65M-0.85M at a second temperature of about 120° F.-180° F. to remove the protective metallic coating from the nickel-based substrate. In this example, the nickel-based substrate includes hafnium in an amount no greater than 1 wt %.

In another aspect, an example method for a repair process includes subjecting a substrate coated with a protective metallic coating to a nitric acid solution having a molarity of 0.07M-0.80M at a first temperature of about 65° F.-160° F. and then subjecting the substrate coated with the protective metallic coating to a hydrochloric acid solution having a molarity of 0.65M-0.85M at a second temperature of about 120° F.-180° F. to remove the protective metallic coating from the substrate. In this example, the substrate includes about 5 wt %-15 wt % chromium, about 2 wt %-8 wt % cobalt, about 2 wt %-6 wt % tungsten, about 0.5 wt %-2.5 wt % titanium, about 8 wt %-16 wt % tantalum, about 2 wt %-8 wt % aluminum, hafnium in an amount no greater than 1 wt %, and a balance of nickel.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
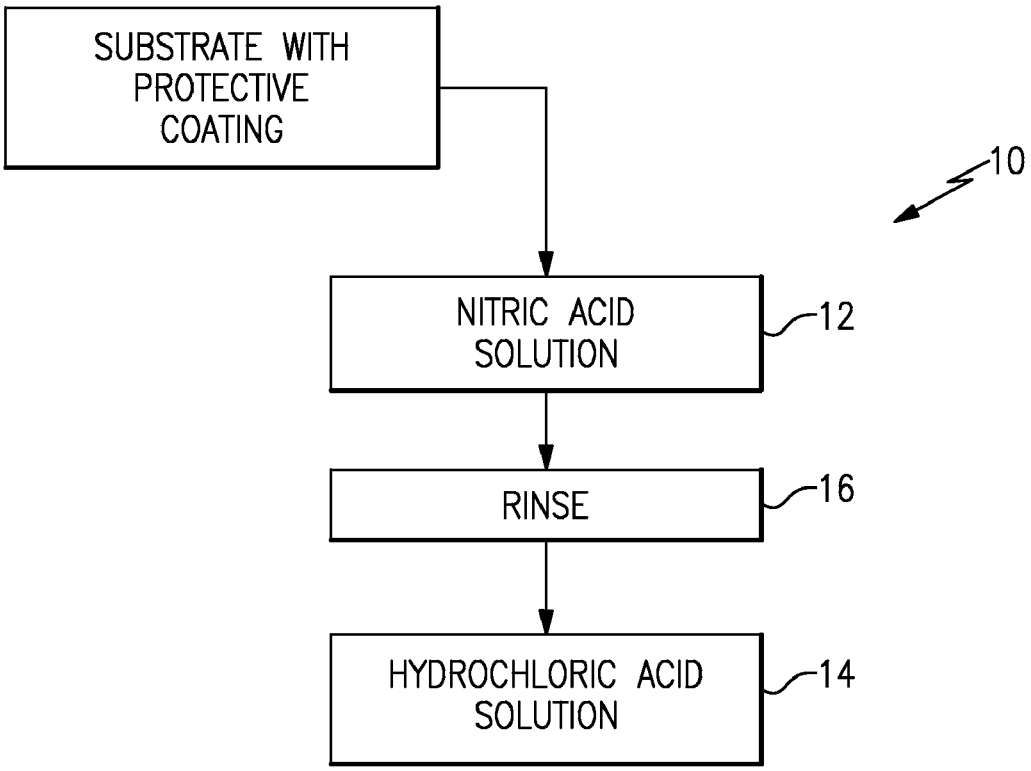
FIG. 1 illustrates an example method for a repair process.

FIG. 1 illustrates an example method 10 for use in a repair process. The repair process may be any type of repair process that may benefit from this disclosure. For example, the repair process may be associated with restoring an article, such as a gas turbine engine component (e.g., airfoil) after a period of use within a gas turbine engine. A repair person may remove the airfoil from the gas turbine engine, strip the airfoil of its protective coating or coatings using the disclosed method 10, repair the airfoil in a suitable manner, and apply new protective coatings to the airfoil before the next cycle of use. The airfoil repair may include restoring eroded or corroded portions using repair techniques, such as welding, brazing or other technique, but is not limited to any particular type of repair. Accordingly, there is a need for the disclosed method 10 that facilitates removal of a coating from a nickel substrate using a two stripping solutions without detriment to the nickel substrate.

In the disclosed example, the article for the repair includes a nickel-based substrate coated with at least one protective metallic coating. The nickel-based substrate may include any composition that is suitable for the intended use of the article. In one example, the nickel-based substrate includes about 5 wt %-15 wt % of chromium, about 2 wt %-8 wt % of cobalt, about 2 wt %-6 wt % of tungsten, about 0.5 wt %-2.5 wt % of titanium, about 8 wt %-16 wt % of tantalum, about 2 wt %-8 wt % of aluminum, hafnium in an amount no greater than 1 wt %, and a balance of nickel. In a further example, the nickel-based substrate includes about 9.5 wt %-10.5 wt % of chromium about 4.5 wt %-5.5 wt % of cobalt, about 3.75 wt %-4.25 wt % of tungsten, about 1.25 wt %-1.75 wt % of titanium, about 11.75 wt %-12.25 wt % of tantalum, about 4.75 wt %-5.25 wt % of aluminum, about 0.25 wt %-0.45 wt % of hafnium, and the balance of nickel. The term "about" as used in this description relative to compositions or other values refers to possible variation in the given value, such as normally accepted variations or tolerances in the art.

In the above example compositions, the hafnium may be present in the form of hafnium carbide and may be undesirably susceptible to chemical etching by certain acid stripping solutions. Therefore, the given example alloys of the nickel-based substrate may be sensitive to the type of stripping solution, solution concentration, length of time exposed to the solution, and solution temperature used to remove the at least one protective metallic coating. As will be described below, the disclosed method 10 and stripping solutions limit or eliminate chemical etching of the nickel-based substrate.

The at least one protective metallic coating may be any desired composition and may include a single coating or multiple coatings, depending upon the type of article. In some examples, the article may also include a ceramic top coat, such as yttria stabilized zirconia, that may be removed using a known removal technique prior to using the method 10.

In one example, the at least one protective metallic coating includes a diffused chromium coating. The diffused chromium coating may be comprised of a minimum of 20 wt % of chromium and iron in an amount no greater than 3 wt %.

Optionally, the at least one protective metallic coating also includes a second coating on top of the diffused chromium coating. For example, the second coating includes nickel, cobalt, chromium, aluminum, yttrium, hafnium, and silicon. In a further example, the second coating includes about 20 wt %-24 wt % of cobalt, about 15 wt %-19 wt % of chromium, about 10 wt %-15 wt % of aluminum, about 0.2 wt %-1 wt % of yttrium, about 0.1 wt %-0.4 wt % of hafnium, about 0.2 wt %-0.6 wt % of silicon, and a balance of nickel. In a further example, the second coating includes about 22 wt % of cobalt, about 17 wt % of chromium, about 12.5 wt % of aluminum, about 0.6 wt % of yttrium, about 0.25 wt % of hafnium, about 0.4 wt % of silicon, and the balance of the nickel.

If the example article is an airfoil having an airfoil section that extends from a platform section, the above example protective metallic coatings may be disposed on the airfoil section. In another example, the example protective metallic coatings are disposed on the platform section of the airfoil, and the amount of chromium in the second coating is greater than the amount of cobalt.

Additionally in the above examples, the protective metallic coatings may have any suitable thickness. For example, any of the given example protective metallic coating may have a thickness up to about 0.15 inches (3.8 millimeters). In one example, each of the protective metallic coatings has a thickness less than about 0.01 inches (0.254 millimeters). Given this description, one of ordinary skill in the art will recognize other suitable thicknesses to meet their particular needs.

To remove the given example metallic coatings from the article, the article is subjected to a nitric acid solution 12 and subsequently subjected to a hydrochloric acid solution 14. For example, the article or a group of like articles may be submerged into a first container of the nitric acid solution 12 and subsequently submerged into a second container of the hydrochloric acid solution 14. For instance, the article may be supported on a fixture or a rack in the containers. However, the article may be subjected to the solutions in any other suitable manner, such as dunking or spraying, and is not limited to submerging.

Optionally, the article is rinsed with water 16 between the nitric acid solution 12 and the hydrochloric acid solution 14 to prevent reaction between any residual nitric acid on the article and the hydrochloric acid. Additionally, the nitric acid solution 12, the hydrochloric acid solution 14, or both may be agitated to facilitate coating removal.

The combination of the nitric acid solution 12 and the hydrochloric acid solution 14 removes the at least one protective metallic coating from the substrate with little or no chemical etching of the nickel-based substrate. For example, the nitric acid solution 12 is less chemically aggressive than the hydrochloric acid solution 14 with regard to the at least one protective metallic coating. Thus, the nitric acid solution 12 infiltrates the at least one protective metallic coating and chemically "loosens" the coating before the more aggressive hydrochloric acid solution 14 chemically removes the at least one protective metallic coating to complete the removal process.

In the disclosed example, the molarity of the nitric acid solution 12 is about 0.07M-0.8M and the molarity of the hydrochloric acid solution 14 is about 0.65M-0.85M. In a further example, the molarity of the nitric acid solution 12 is about 0.15M-0.2M and the molarity of the hydrochloric acid solution is about 0.7M-0.8M. In a further example, the molarity of the nitric acid solution 12 is about 0.17M and the molarity of the hydrochloric acid solution is about 0.75M.

The disclosed nitric acid solution 12 may be prepared from mixing a technical grade of "as-received" nitric acid, such as 42° Baumé 67.5 wt % nitric acid, with an appropriate amount of water to achieve a desired molarity. Likewise, the disclosed hydrochloric acid solution 14 may be prepared from mixing a technical grade of "as-received" hydrochloric acid, such as 20° Baumé 31.5 wt % hydrochloric acid, with an appropriate amount of water to achieve a desired molarity. As can be appreciated, any concentrations of the "as-received" acids may be used to achieve the desired molarities, but the amounts of water mixed may be varied based on the "as-received" concentrations to achieve the desired molarities. Given this description, one of ordinary skill in the art will be able to recognize the appropriate amounts of water to achieve a desired molarities for a given "as-received" acid concentration.

The given example concentrations provide the benefit of effectively removing the at least one protective metallic coating without detriment to the nickel-based substrate. For example, a weaker concentration of the nitric acid solution 12 may not suitably chemically "loosen" the at least one protective metallic coating and a stronger concentration of the nitric acid solution 12 may chemically damage the nickel-based substrate. Likewise, a weaker concentration of the hydrochloric acid solution 14 may not suitably chemically remove the at least one protective metallic coating and a stronger concentration of the hydrochloric acid solution 14 may chemically damage the nickel-based substrate.

At the given example concentrations, the article is subjected to the nitric acid solution 12 at a first temperature of about 60° F.-160° F. and to the hydrochloric acid solution at a second temperature of about 120° F.-180° F. to achieve removal. In one example, the first temperature is 60° F.-80° F. and the second temperature is 140° F.-160° F. Selecting the first temperature to be near ambient provides the benefit of facilitating removal of the at least one protective metallic coating without having to heat the nitric acid solution 12.

The article may be exposed to the nitric acid solution 12 and the hydrochloric acid solution 14 for a predetermined amount of time to remove the at least one protective metallic coating. In one example, the article is subjected to the nitric acid solution 12 for about two hours and to the hydrochloric acid solution 14 for about one hour. As can be appreciated, the concentrations, times, and temperatures may be adjusted within the given ranges, depending on the thickness of the at least one protective metallic coating or other parameters. Given this description, one of ordinary skill in the art would be able to recognize other exposure times to meet their particular needs.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method for a repair process, comprising:

(a) subjecting a substrate coated with at least one protective metallic coating to a nitric acid solution having a molarity of 0.07M-0.80M at a first temperature of about 60° F.-160° F., the substrate being comprised of about 5 wt %-15 wt % chromium, about 2 wt %-8 wt % cobalt, about 2 wt %-6 wt % tungsten, about 0.5 wt %-2.5 wt % titanium, about 8 wt %-16 wt % tantalum, about 2 wt %-8 wt % aluminum, hafnium in an amount no greater than 1 wt %, and a remainder of nickel; and (b) after said step (a), subjecting the substrate coated with the at least one protective metallic coating to a hydrochloric acid solution having a molarity of 0.65M-0.85M at a second temperature of about 120° F.-180° F. to remove the at least one protective metallic coating from the substrate and limit etching of hafnium carbide in the substrate.

2. The method as recited in claim 1, wherein the substrate includes about 9.5 wt %-10.5 wt % of the chromium, about 4.5 wt %-5.5 wt % of the cobalt, about 3.75 wt %-4.25 wt % of the tungsten, about 1.25 wt %-1.75 wt % of the titanium, about 11.75 wt %-12.25 wt % of the tantalum, about 4.75 wt %-5.25 wt % of the aluminum, about 0.25 wt %-0.45 wt % of the hafnium, and the balance of nickel.

3. The method as recited in claim 1, wherein the at least one protective metallic coating includes chromium.

4. The method as recited in claim 3, wherein the at least one protective metallic coating includes at least about 20 wt % of the chromium and iron in an amount no greater than 3 wt %.

5. The method as recited in claim 1, wherein the at least one protective metallic coating includes nickel, cobalt, chromium, aluminum, yttrium, hafnium, and silicon.

6. The method as recited in claim 5, wherein the at least one protective metallic coating includes about 20 wt %-24 wt % of the cobalt, about 15 wt %-19 wt % of the chromium, about 10 wt %-15 wt % of the aluminum, about 0.2 wt %-1 wt % of the yttrium, about 0.1 wt %-0.4 wt % of the hafnium, about 0.2 wt %-0.6 wt % of the silicon, and a remainder of the nickel.

7. The method as recited in claim 5, wherein the at least one protective metallic coating includes about 22 wt % of the cobalt, about 17 wt % of the chromium, about 12.5 wt % of the aluminum, about 0.6 wt % of the yttrium, about 0.25 wt % of the hafnium, about 0.4 wt % of the silicon, and the balance of the nickel.

8. The method as recited in claim 1, wherein the at least one protective metallic coating comprises a first coating including chromium and a second coating including about 20 wt %-24 wt % of cobalt, about 15 wt %-19 wt % of chromium, about 10 wt %-15 wt % of aluminum, about 0.2 wt %-1 wt % of yttrium, about 0.1 wt %-0.4 wt % of hafnium, about 0.2 wt %-0.6 wt % of silicon, and a balance of nickel.

9. The method as recited in claim 1, further comprising agitating at least one of the nitric acid solution or the hydrochloric acid solution.

10. The method as recited in claim 1, further comprising rinsing the substrate coated with the at least one protective metallic coating with water between said step (a) and said step (b).

11. The method as recited in claim 1, wherein step (a) includes subjecting the substrate coated with the at least one protective metallic coating to the nitric acid solution for a first amount of time and step (b) includes subjecting the substrate coated with the at least one protective metallic coating to the hydrochloric acid solution for a second amount of time that is different than the first amount of time.

12. The method as recited in claim 11, wherein the first amount of time is greater than the second amount of time.

13. The method as recited in claim 11, wherein a ratio of the first amount of time to the second amount of time is about two.

14. A method for a repair process, comprising:

(a) subjecting a nickel-based substrate coated with at least one protective metallic coating to a nitric acid solution having a molarity of 0.07M-0.80M at a first temperature of about 60° F.-160° F., the nickel-based substrate including hafnium in an amount no greater than 1 wt %; and (b) after said step (a), subjecting the nickel-based substrate coated with the at least one protective metallic coating to a hydrochloric acid solution having a molarity of 0.65M-0.85M at a second temperature of about 120° F.-180° F. to remove the at least one protective metallic coating from the nickel-based substrate and limit etching of hafnium carbide in the nickel-based substrate.

15. The method as recited in claim 14, further comprising selecting the molarity of the nitric acid solution to be 0.15M-0.20M.

16. The method as recited in claim 14, further comprising selecting the molarity of the nitric acid solution to be 0.17M.

17. The method as recited in claim 14, further comprising selecting the molarity of the hydrochloric acid solution to be 0.7M-0.8M.

18. The method as recited in claim 14, further comprising selecting the molarity of the hydrochloric acid solution to be 0.75M.

19. The method as recited in claim 14, including subjecting the nickel-based substrate coated with the at least one protective metallic coating to the nitric acid solution for about two hours with the first temperature at about 60° F.-80° F., and subjecting the nickel-based substrate coated with the at least one protective metallic coating to the hydrochloric acid solution for about one hour with the second temperature at about 140° F.-160° F.

20. The method as recited in claim 14, wherein the nickel-based substrate includes about 5 wt %-15 wt % of chromium, about 2 wt %-8 wt % of cobalt, about 2 wt %-6 wt % of tungsten, about 0.5 wt %-2.5 wt % of titanium, about 8 wt %-16 wt % of tantalum, about 2 wt %-8 wt % of aluminum, hafnium in an amount no greater than 1 wt %, and a balance of nickel, and the at least one protective metallic coating includes chromium.

* * * * *